US006079690A

United States Patent [19]

Yoon

[11] Patent Number: 6,079,690

[45] Date of Patent: Jun. 27, 2000

[54] SCREW SPINDLE ASSEMBLY OF SWIVEL CHAIR

[75] Inventor: Young Ki Yoon, Pucheon-shi, Rep. of Korea

[73] Assignee: Samhongsa Co., Ltd., Seoul, Rep. of Korea

[21] Appl. No.: 09/084,422

[22] Filed: May 27, 1998

[30] Foreign Application Priority Data

Jun. 2, 1997 [KR] Rep. of Korea ..... 97-22677

[51] Int. Cl.[7] ..... F16M 13/00

[52] U.S. Cl. ..... 248/622; 248/415; 248/578; 248/601; 192/67; 411/150

[58] Field of Search ..... 248/622, 578, 248/405, 600, 601, 415; 192/67; 411/150

[56] References Cited

U.S. PATENT DOCUMENTS

| | | | |
|---|---|---|---|
| 1,501,180 | 1/1924 | Peters et al. | 248/405 |
| 2,384,584 | 9/1945 | Wildhaber | 192/67 |
| 2,501,976 | 3/1950 | Vitek | 155/93 |
| 3,198,324 | 8/1965 | Kallenbach et al. | 206/46 |
| 3,391,893 | 7/1968 | Doerner | 248/405 |
| 3,870,271 | 3/1975 | Bowman | 248/406 |
| 4,315,613 | 2/1982 | Godwin et al. | 248/406 |
| 4,613,106 | 9/1986 | Tornero | 248/405 |
| 4,860,987 | 8/1989 | Werner | 248/405 |
| 4,872,635 | 10/1989 | Knoblock et al. | 248/406.2 |
| 5,031,869 | 7/1991 | Strater et al. | 248/406.1 |
| 5,462,248 | 10/1995 | Bauer | 248/161 |
| 5,722,627 | 3/1998 | Hoshino | 248/405 |
| 5,749,557 | 5/1998 | Chang | 248/405 |
| 5,816,556 | 10/1998 | Liao | 248/405 |

*Primary Examiner*—Ramon O. Ramirez
*Assistant Examiner*—Walter Landry

[57] ABSTRACT

A screw spindle of a swivel chair according to the present invention comprises a spindle which is placed in an outer case; an elastic body which is placed in the spindle; a bearing support which is placed in the spindle; a ball bearing component which is placed in the spindle; a screw nut and a clutch, each having a corresponding furrow and ridge with curved surfaces, which are placed in the spindle; a screw shaft which is placed in the spindle; a fixer and a clip which hold the screw shaft in place; and a stopper which is formed at the screw shaft and limits the height of the seat; a spindle bushing located between the screw shaft and the elastic body. The screw shaft further includes an idling protection component and a fixing end, and the fixer includes an idling protection hole corresponding to the idling protection component.

The screw spindle of the present invention has the following advantages. There is no shock and noise because the clutch and the screw nut have curved furrows and ridges; there is no noise resulting from trembling of the elastic body because the spindle bushing guides the elastic body to move up and down in a precise vertical direction; disassembling of the screw spindle is easy for repairing or replacing the ball bearing component because the stopper has a smaller diameter than the screw shaft; no welding equipment is required to assemble the screw spindle, resulting in the reduction of the manufacturing costs and tidiness of the work place, because the screw shaft is fixed to the fixer by using the clip.

4 Claims, 11 Drawing Sheets

SCREW SPINDLE ASSEMBLY OF SWIVEL CHAIR

BACKGROUND OF THE INVENTION

1. Field of the Invention

The present invention relates to a screw spindle assembly of a swivel chair, more particularly to a screw spindle assembly comprised of a clutch which works smoothly so as to give comfort to users; a spindle bushing, which guides an elastic body (i.e. a spring) to move up and down precisely, so as to reduce noise; and a stopper having a same diameter as that of a screw shaft, which are placed on the top of the screw shaft so that a screw nut cannot be detached from the screw shaft.

2. Description of the Related Art

Conventionally, a screw spindle assembly of a swivel chair is located at the bottom of the chair so as to control the height of the chair.

FIG. 1 is an exploded view showing a screw spindle assembly of a conventional swivel chair. FIG. 2 is a cross-sectional view showing the screw spindle assembly of the conventional swivel chair. Reference number 10 is a hollow, cylindrical outer case. Number 20 is the spindle which is mounted in the outer case 10. The spindle 20 includes a tapered end 22 and an inner pipe 24 having a cock which holds a support ring mentioned below.

The spindle 20 encloses an elastic body 30, i.e. a spring, which provides more comfort to users; a ball bearing component which accommodates the smooth revolution of the spindle 20; a rubber ring 60 which maintains the height of the seat; and a screw nut and a clutch 80 which hold the seat at a desirable height.

Reference number 12 is a spindle guide which is placed between the top of the outer case 10 and the top of the spindle 20 and holds them in place. Reference number 32 is a support ring which is placed between the cock 24a and the elastic body 30. Reference numbers 42 and 44 are bearing supports which sandwich and protect the ball bearing component 50, and reference number 52 is a ball bearing found in the ball bearing component 50.

In the spindle, a screw shaft 90 penetrates through the all of the elements which include the elastic body 30, the ball bearing component 50, the rubber ring 60, the screw nut 70 and the clutch 80. The fixer 100, which is comprised of a fixing hole 102 in the shape of a circle, is placed at the bottom of the screw shaft 90 so that the idle-revolution of the screw shaft 90 is prevented.

The screw shaft 90 has a fixing end 92 at the bottom thereof, which corresponds to the fixing hole 102, and a cylindrical nut support 94 is provided in order to prevent the screw nut 70 from coming down completely.

The clutch 80 is attached to the bottom of the spindle 20 by a curling method.

FIG. 5 is a cross-sectional view showing the screw nut 70 and the clutch 80 of the screw spindle assembly of the conventional swivel chair. The screw nut and the clutch are described in detail with reference to FIG. 5. The screw nut 70 includes a tapered mouth 72, into the top of which the rubber ring 60 will be inserted. It also includes a female screw 74 which corresponds to a grooved portion of the screw shaft 90; and grooves 78, which will be engaged with the clutch 80, at the bottom of the screw nut. The clutch 80, which is engaged with the grooves of the screw nut 70 and rotates, includes protruding parts 82 at the top thereof. Each groove 78 of the screw nut 70 is geared with each protruding part 82 of the clutch 80.

FIG. 8 is a cross-sectional view showing a portion of the stoppers 90*a*, 90*b* and 90*c* holding the screw shaft of the screw spindle assembly of the conventional swivel chair. These stoppers 90*a*, 90*b* and 90*c* prevent the screw nut 70 and the clutch 80 from being disassembled.

The stopper 90*a* is a sill-type which has embossed portions larger than the screwed portions in diameter, the stopper 90*b* is a cylinder-type to which a cylindrical body is attached, and the stopper 90*c* is a welding-type in which the furrows and ridges of the screw shaft 90 are welded so that an idle-revolution occurs at that stopper position.

FIG. 10 is a cross-sectional view showing how the screw shaft 90 is fixed to the fixer 100. The fixer 100 supporting the screw shaft 90 is welded to the bottom of the outer case 10. The fixer 100 includes the fixing hole 102 at the center thereof so that the screw shaft 90 is inserted into the fixing hole 102. The lower circumference of the fixing hole and the fixing end 92 which is inserted into the fixing hole are welded as depicted by reference number 98 in FIG. 10 so that the screw shaft 90 is stably attached to the fixer 100. The outer case 10 and the fixer 100 are fixed together by a cocking part 107, and viscid grease is placed between the screw shaft 90 and the screw nut 70 to facilitate smooth movement.

The conventional swivel chair which comprises the spindle screw described above is manufactured by mounting a seat on the top of the spindle screw and placing the bottom of the outer case 10 to the center of the chair-leg.

The height of the chair, i.e. the length between the floor and the seat of the chair, is adjustable. In other words, the height of the chair is controlled by rotating the seat clockwise and counter-clockwise. In accordance with the rotation of the seat, the spindle 20 which is connected to the seat rotates, and the clutch 80 also rotates because the clutch 80 is attached to the bottom of the spindle 20 via cocking.

The clutch 80 is engaged with the screw nut 70 so that the screw nut 70 moves up and down in relation to the screw shaft 90. In other words, the rotation of the spindle 20 is converted to the vertical motion of the rotating spindle so that the seat moves up and down in accordance with the vertical motion of the rotating spindle 20 because the screw shaft 90 is attached to the outer case 10 by the fixer 100.

When some weight is applied to the spindle 20, i.e. when a user sits on the chair, the spindle 20 moves down and clutch 80 detaches from the nut 70. When no weight is applied to the spindle 20, i.e. when the chair is not being used, the spindle 20 moves up and the clutch 80 attaches to the nut 70. Therefore, the height of the chair is controlled by engaging the clutch 80 with the nut 70.

The conventional swivel chair described above has the following problems.

1. The cross sectional shapes of furrows 78 and ridges 82 of the nut 70 and the clutch 80 are rectangular (see FIG. 5). When the nut 70 and the clutch 80 are precisely engaged, neither shock nor noise occur. However, when the nut 70 and the clutch 80 are not precisely engaged, i.e. furrows of the clutch 80 and the nut 70 meet unintentionally, the clutch 80 and the nut 70 are re-engaged by the elastic body 30, and shock and noise occur. A user, as a result, feels more discomfort.

2. When some weight is applied to the seat, the elastic body 30 is compressed, and moves down causing friction between it and other components around it. In other words, the elastic body 30 rubs against the thread of the screw shaft 90 and the spindle 20, and noise such as a grinding metal sound occurs. When the elastic body 30 is de-compressed and moves up, the noise reoccurs.

3. Stoppers 90*a*, 90*b* and 90*c* of the conventional screw spindle assembly have the following problems. First, the sill-type stopper 90*a* has a larger diameter than the screw of the screw shaft 90. This stopper makes noise when it contacts the elastic body 30 as the elastic body moves up and down. Further, when components such as ball bearing component 50 require repair or replacement, the spindle screw having this stopper can not be disassembled. Therefore, a new spindle screw must replace the old one, increasing the cost for repairing the spindle 20. Secondly, the cylinder-type stopper 90*b* and the welding-type stopper 90*c* cannot be disassembled from the spindle. Therefore, a new screw spindle assembly is also required to replace the old one when repair or replacement is required, again, increasing the cost for repairing the spindle 20.

4. The fixing end 92 of the screw shaft 90 is welded to the fixer 100 which results in a more complicated manufacturing process and in decreased efficiency. In order to weld the fixing end to the fixer vertically, an expert welder is required. As a result of the welding, a pleasing aesthetic appearance cannot be obtained due to the welded portion. Furthermore this welding requirement makes for a more disorganized work environment.

In addition, it is not easy to form the fixing hole 102 in the fixer 100.

SUMMARY OF THE INVENTION

An objective of the present invention is to eliminate the problems mentioned above. In order to achieve this objective, a soft clutch is used so that a user feels more comfort, and a spindle bushing is used as a guide which helps the elastic body move up and down smoothly and precisely so that noise is eliminated. Furthermore, a stopper portion which has the same diameter as that of the screw shaft is used on the top of the screw shaft so that a screw nut cannot be detached from the screw shaft.

In order to achieve the object, the screw spindle assembly of the present invention comprises a hollow cylindrical outer case; a spindle placed in the outer case, the spindle having a tapered hollow cylindrical first end portion fixed to a chair seat and a hollow cylindrical second end portion; an elastic body placed in the spindle; a support ring making contact with one end of the elastic body to limit a movement of the elastic body; a bearing assembly making contact with the other end of the elastic body and placed in the spindle; a screw nut having internal threads and placed in the spindle, the screw nut having at least one furrow; a clutch fixed to the second end of the spindle, the clutch having at least one ridge corresponding to the furrow of the screw nut; a screw shaft placed in the spindle and inserted into the elastic body, the bearing assembly, and the clutch and engaged with the internal threads of the screw nut; and a fixer fixed to one end of the outer case, the screw nut being fixed to a center portion of the fixer; wherein the furrow of the screw nut and the ridge of the clutch have a curved surface respectively. Preferably, a site at which the furrow of the screw nut and a bottom surface portion of the screw nut meet is sloped with an arc-shape. The screw nut has at least two furrows and the clutch has at least two ridges.

In order to achieve the objectives of this invention, the screw spindle assembly of the present invention comprises a hollow cylindrical outer case; a spindle placed in the outer case, the spindle having a tapered hollow cylindrical first end portion fixed to a chair seat and a hollow cylindrical second end portion; an elastic body placed in the spindle; a support ring making contact with one end of the elastic body to limit a movement of the elastic body; a bearing assembly making contact with the other end of the elastic body and placed in the spindle; a screw nut having internal threads and placed in the spindle, the screw nut having at least one furrow; a clutch fixed to the second end of the spindle, the clutch having at least one ridge corresponding to the furrow of the screw nut; a screw shaft placed in the spindle and inserted into the elastic body, the bearing assembly, and the clutch and engaged with the internal threads of the screw nut; a fixer fixed to one end of the outer case, the screw nut being fixed to a center portion of the fixer; and a spindle bushing placed between the screw shaft and the elastic body, the spindle bushing having a cylindrical body which has a cylindrical hole extending along the length-axis of the cylindrical body, and a protruding portion protruding from the top of the cylindrical body; wherein the protruding portion has a cut-away portion.

The screw shaft has a stopper portion having a same diameter as that of the screw shaft at an upper end portion of the screw shaft, and the stopper portion is formed by merging neighboring threads in order to distort the screw pitch of the screw shaft so that the screw nut cannot be detached from the screw shaft.

DETAILED DESCRIPTION OF THE PREFERRED EMBODIMENTS

Description of the screw spindle assembly of the present invention is made with reference to the accompanying drawings. Components which are used in the conventional art are depicted by the same reference number.

Figure 1:
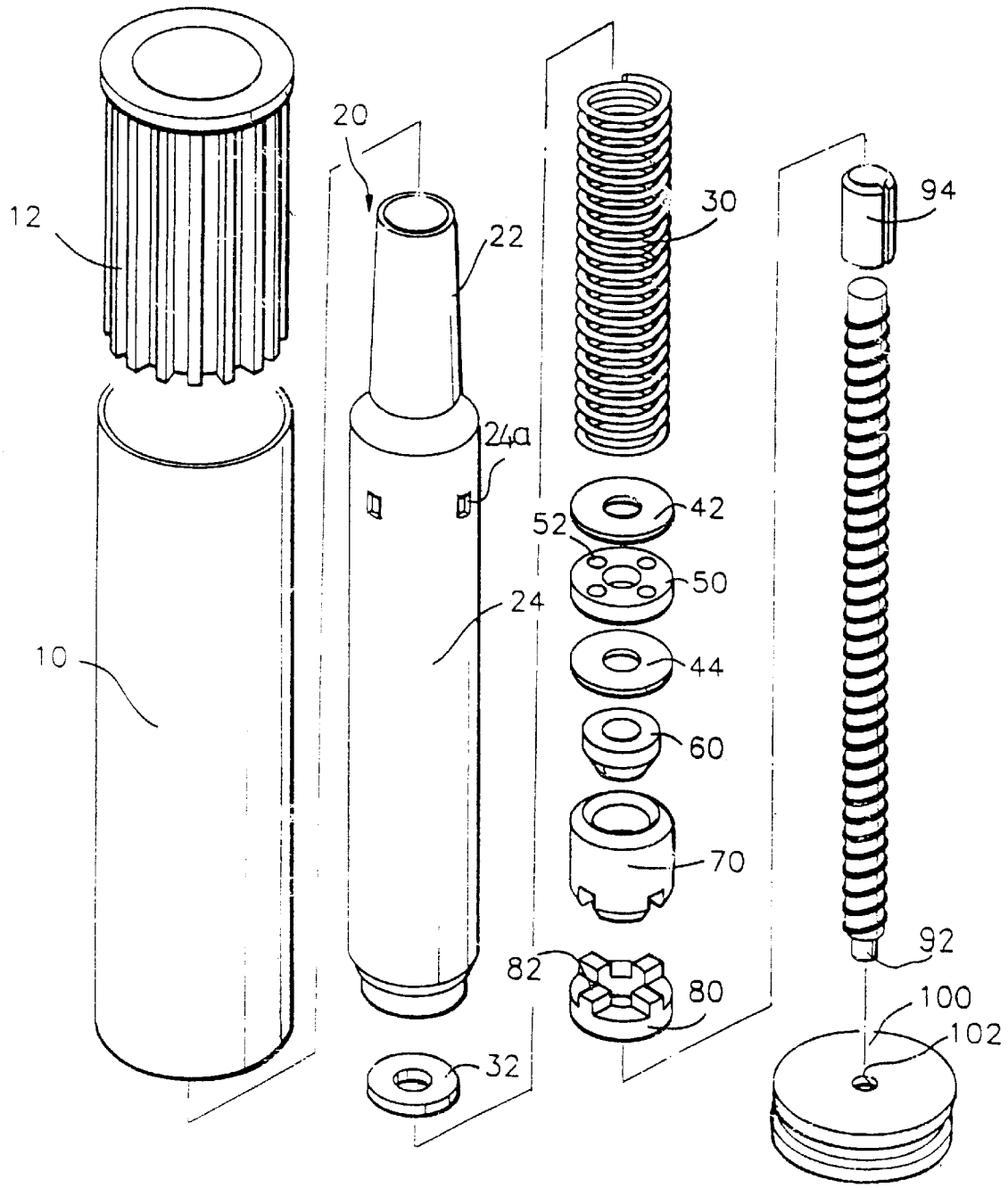
Fig. 1 Prior Art
FIG. 1 is an exploded view showing a screw spindle assembly of a conventional swivel chair.
Figure 2:
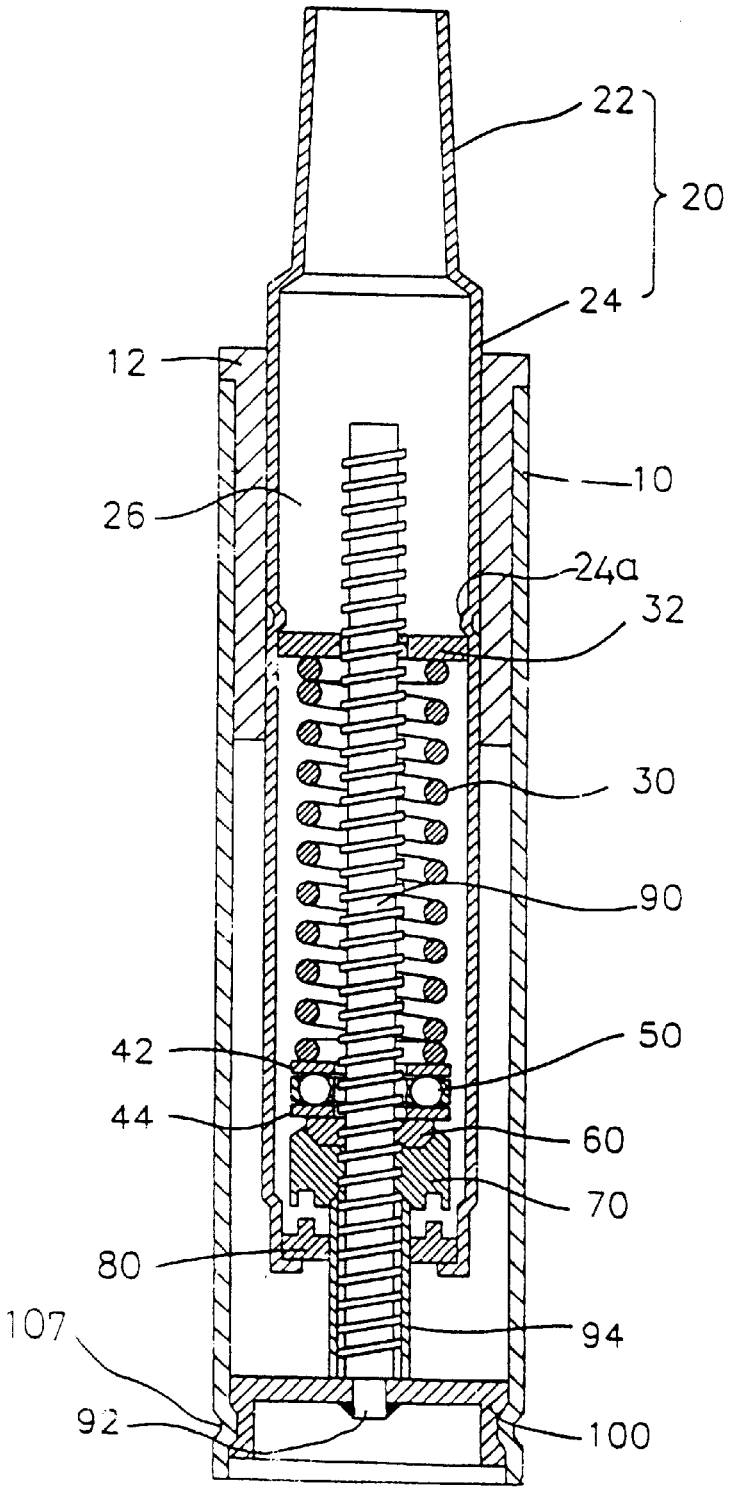
Fig. 2 Prior Art
FIG. 2 is a cross-sectional view showing the screw spindle assembly of the conventional swivel chair.
Figure 3:
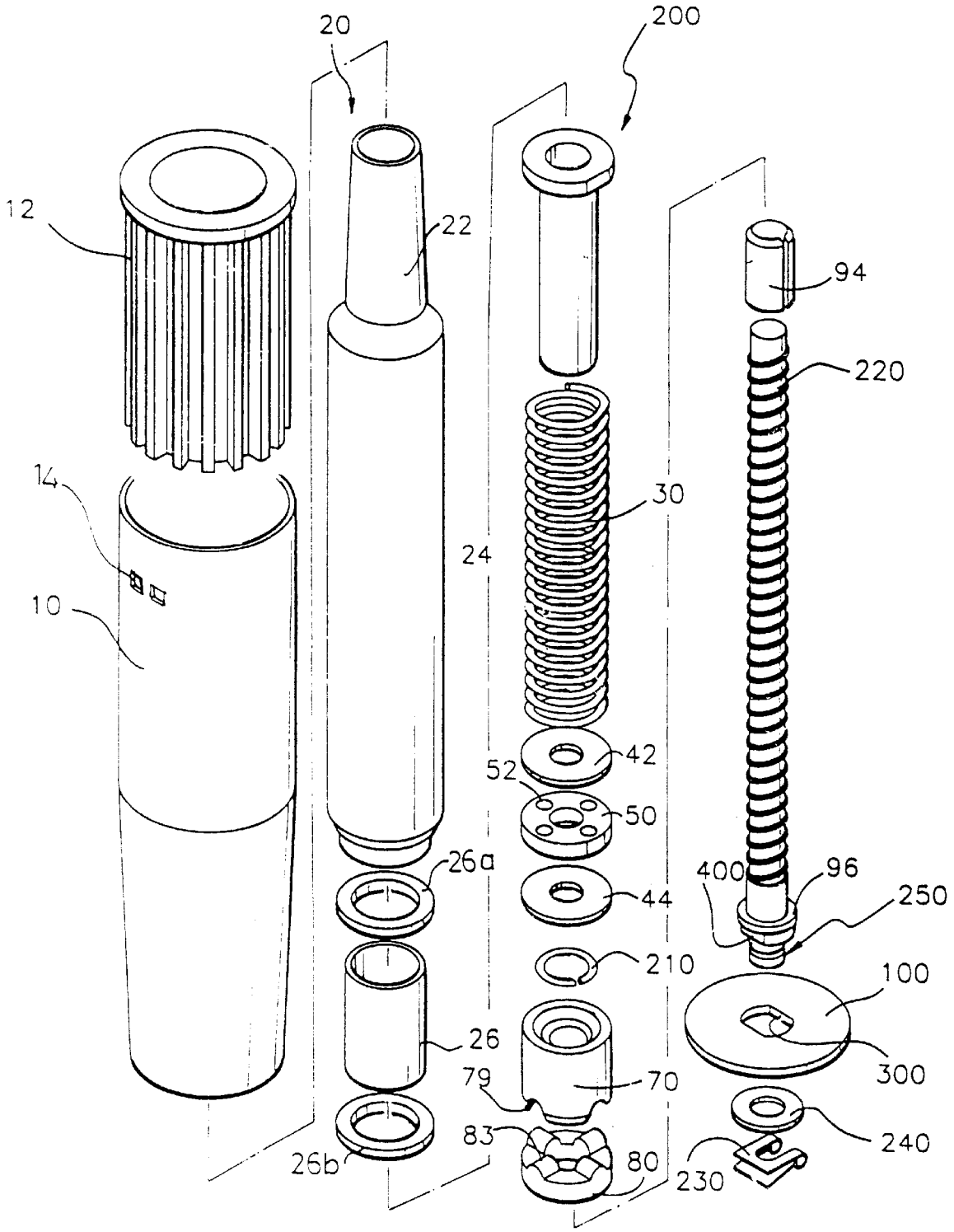
FIG. 3 is an exploded view showing a screw spindle assembly of a swivel chair according to the present invention.
Figure 4:
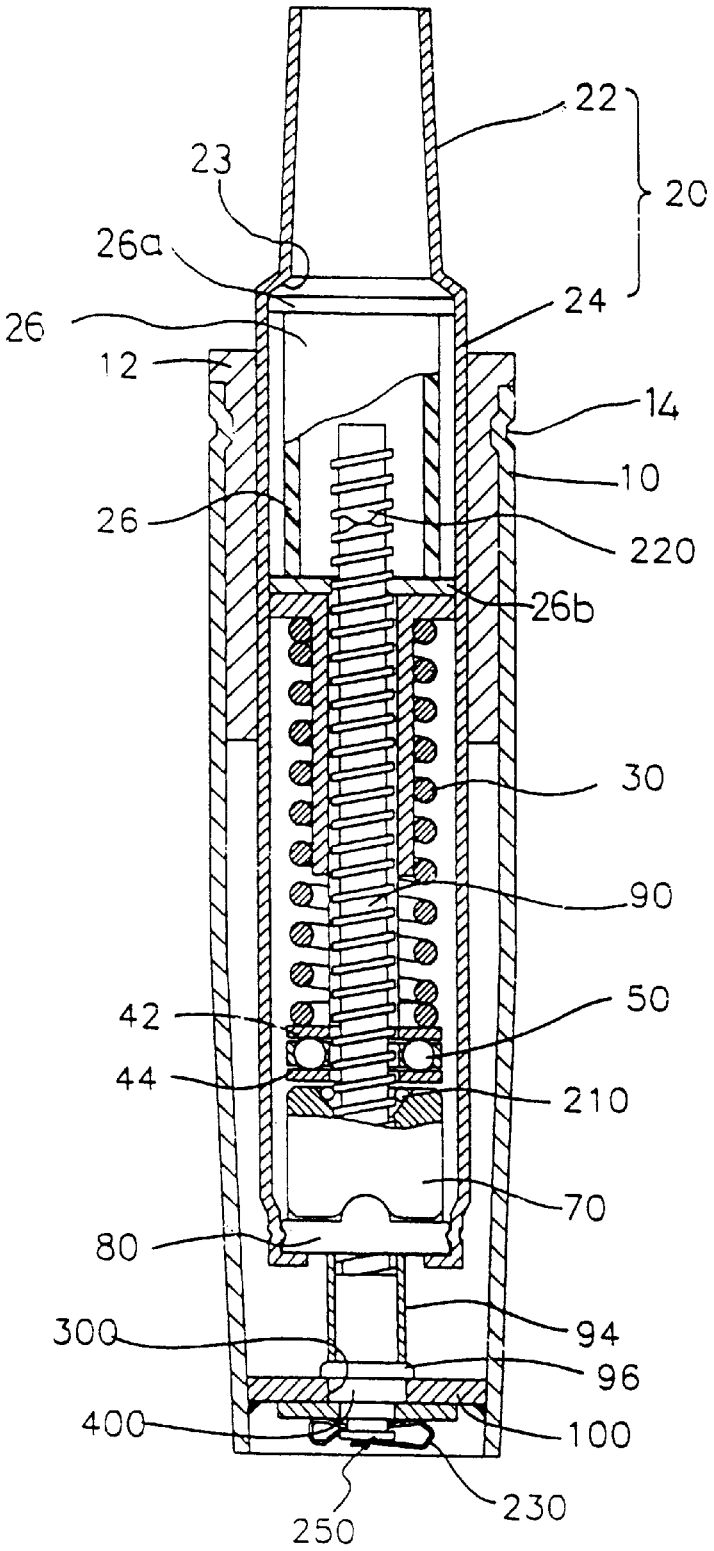
FIG. 4 is a cross-sectional view showing the screw spindle assembly of the present invention.
Figure 5:
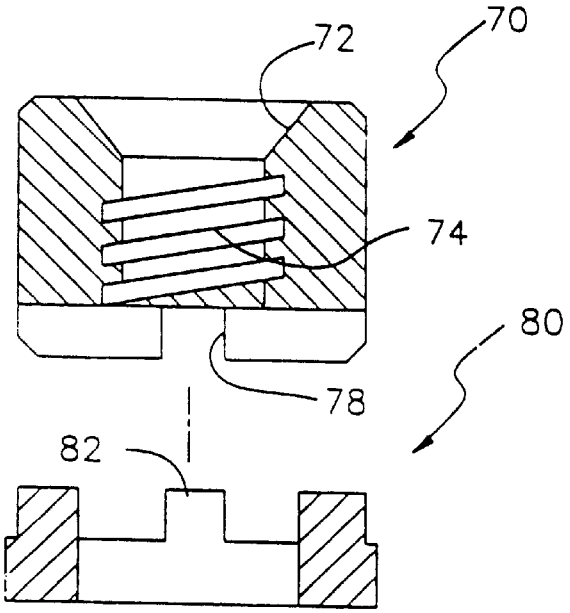
Fig. 5 Prior Art
FIG. 5 is a cross-sectional view showing a screw nut and a clutch of the screw spindle assembly of the conventional swivel chair.

FIG. 3 is an exploded view showing the screw spindle assembly of the present invention. FIG. 4 is a cross-sectional view showing the screw spindle assembly of the present invention.

The present invention particularly comprises a screw nut having curved furrows and a clutch having curved ridges so as to engage each other delicately, resulting in the elimination of noise and in enhanced comfort.

The present invention also comprises a spindle bushing which is placed between the elastic body and the screw shaft and helps the elastic body move up and down precisely.

The present invention further comprises a stopper portion, which has a same diameter as that of the screw shaft and is placed on the top of the screw shaft. Referring to FIG. 4, a ball bearing component 50 is placed at the bottom of the elastic body 30, and a bearing support 42 is inserted between the ball bearing component 50 and the elastic body 30. The top of the elastic body 30 is connected to a lower support ring 26*b* of an inserting component 26 which further includes an upper support ring 26*a*.

Therefore, the elastic force of the elastic body 30 is applied to the upper support ring 26*a* via the lower support ring 26*b* and the body of the inserting component 26. The upper support ring 26*a* is fixed at the stepped portion 23 which is formed between the inserting part 22 and the inner pipe 24 so that the elastic body 30 does not escape from the inner pipe 24.

In FIGS. 3 and 4, reference number 14 is a cocking part which is formed on the surface of the outer case 10 and holds the spindle guide 12 in place. Reference number 210 is a spring washer which is settled in the tapered mouth 72 of the screw nut 70 and prevents inadvertent changes of the height of the spindle 20 when weight is applied to the spindle 20.

Figure 6:
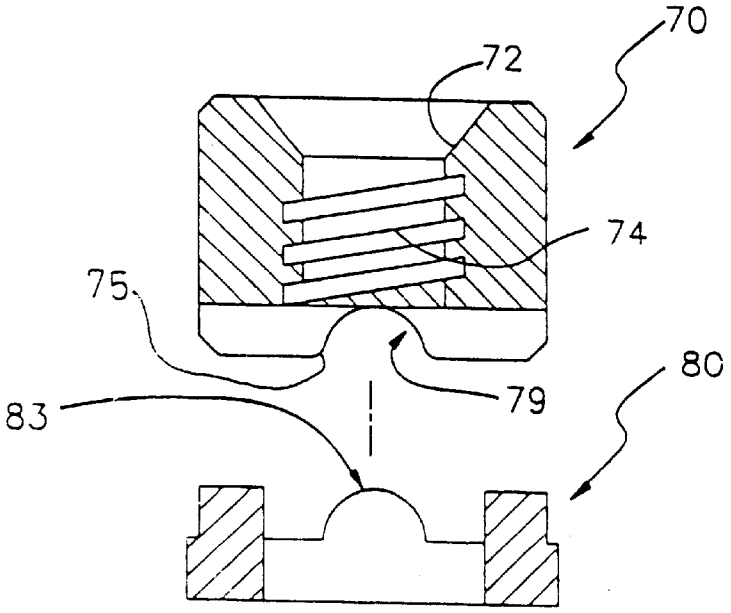
FIG. 6 is a cross-sectional view showing a screw nut and a clutch of the screw spindle assembly of the present invention.

FIG. 6 is a cross-sectional view showing the screw nut and the clutch of the present invention. The screw nut 70 and the clutch 80 of the present invention have curved surfaces 79 and 83 of the furrows 78 and ridges 82.

Portions of the bottom plane surface 77 of the screw nut which meet the curved surface 79 of the furrow of the screw nut are sloped with an arc-shape as depicted by 75 in FIG. 6. The ridges 82 of the clutch 80 slide smoothly into the furrows 78 of the screw nut 70, and results in increased comfort.

Figure 7:
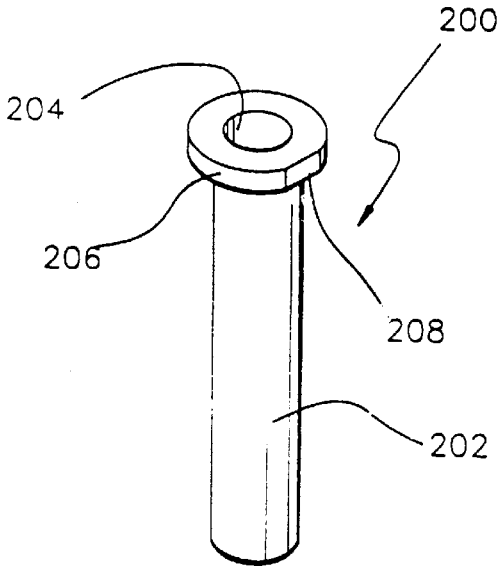
FIG. 7 is a three-dimensional view of a spindle bushing of the screw spindle assembly of the present invention.
Figure 8:
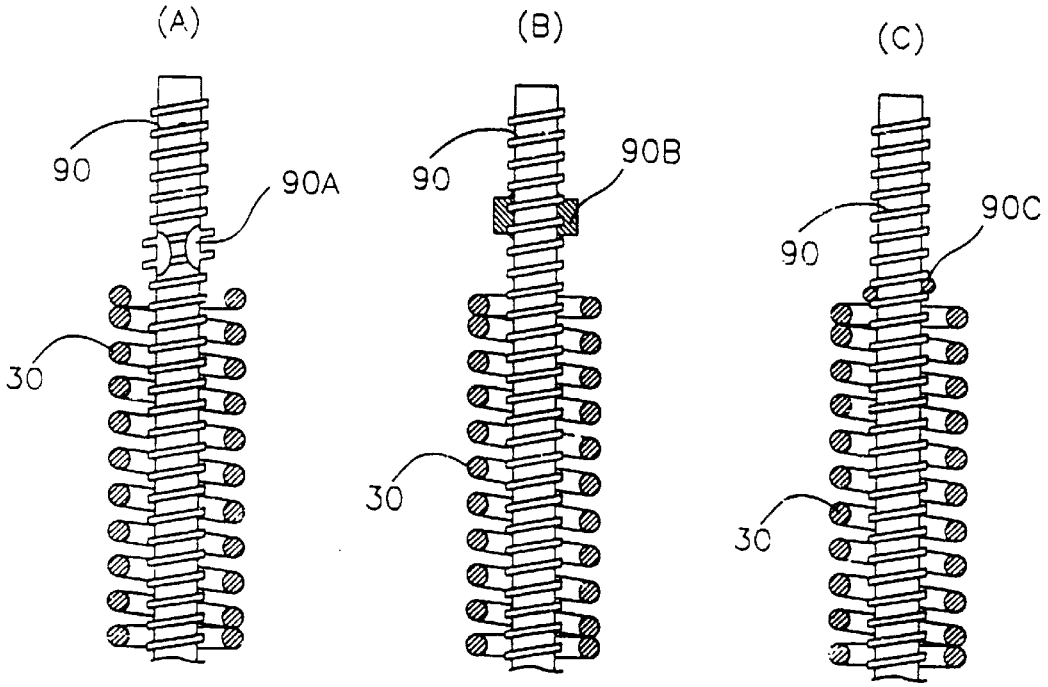
Fig. 8 Prior Art
FIG. 8 is a cross-sectional view showing a stopper of the screw spindle assembly of the conventional swivel chair.

FIG. 7 is a three-dimensional view showing a spindle bushing 200 of the screw spindle assembly of the present invention. The spindle bushing 200 includes a cylindrical body 202 which has a cylindrical hole 204 extending along with the length-axis and a protruding portion 206 which protrudes circularly from the top of the cylindrical body 202 and rests on top of the elastic body 30. The screw shaft 90 is inserted through the cylindrical hole 204. The protruding portion 206 includes a cut away portion 208 for convenient assembly.

Figure 9A:
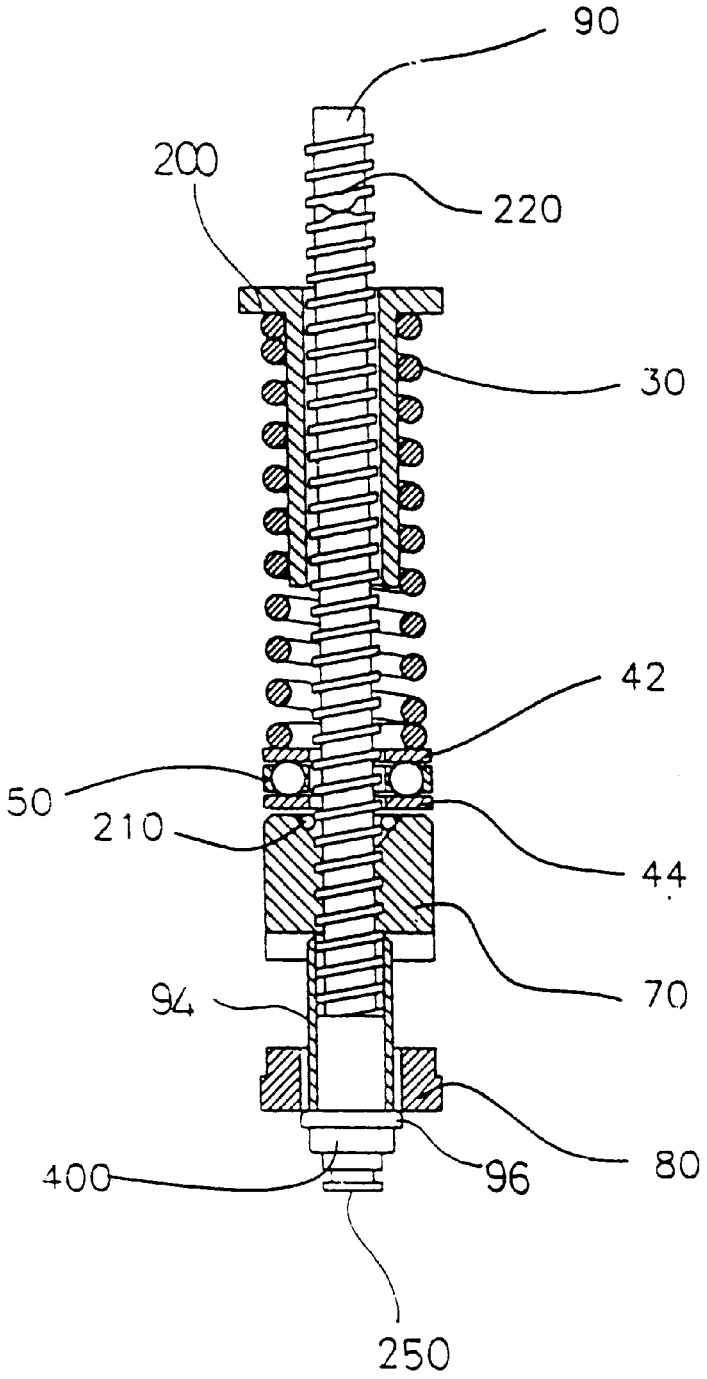
FIG. 9*a* is a cross-sectional view showing a stopper of the screw spindle assembly according to one embodiment of the present invention.
Figure 9B:
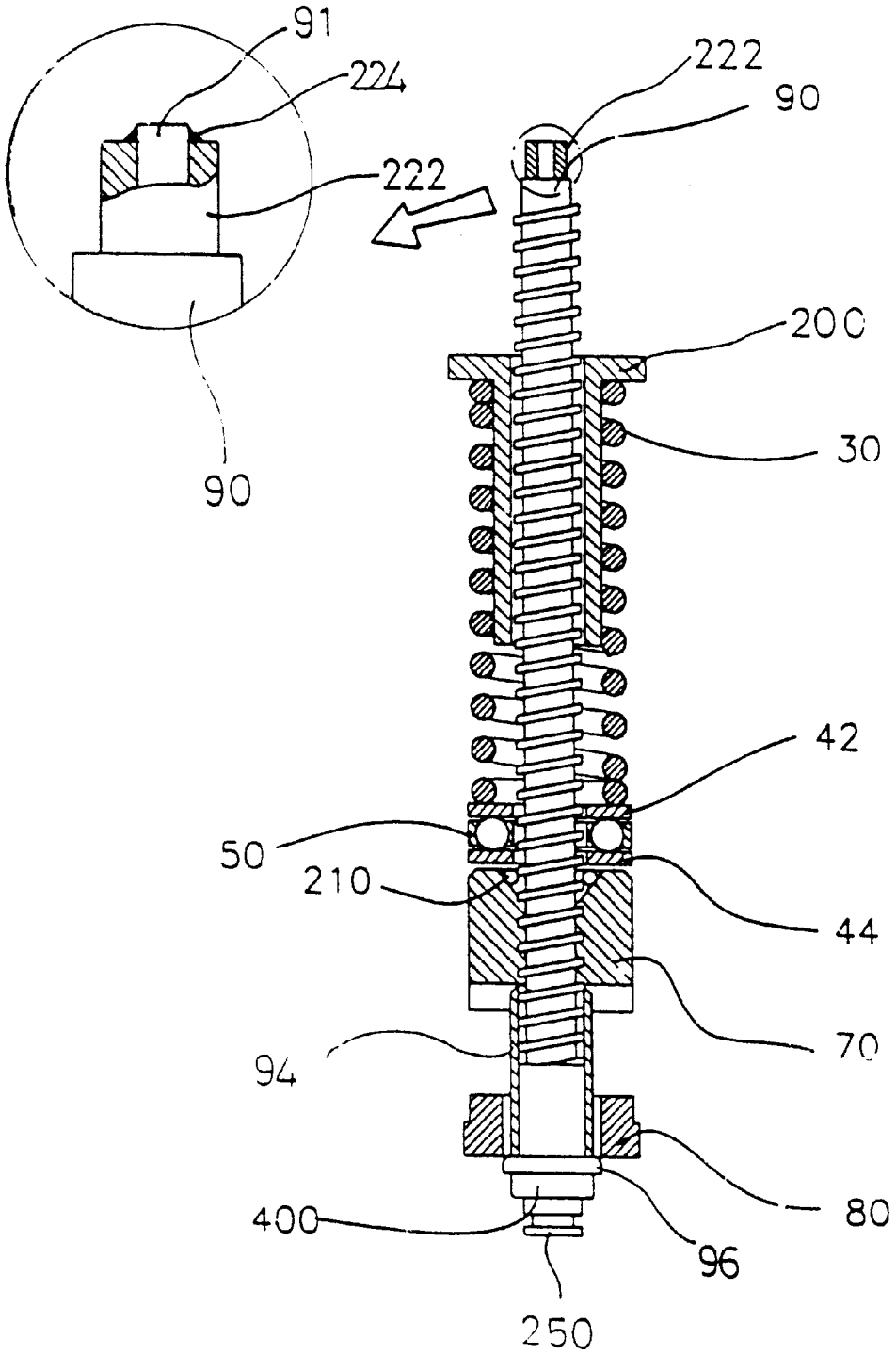
FIG. 9*b* is a cross-sectional view showing a stopper of the screw spindle assembly according to another embodiment of the present invention.
Figure 10:
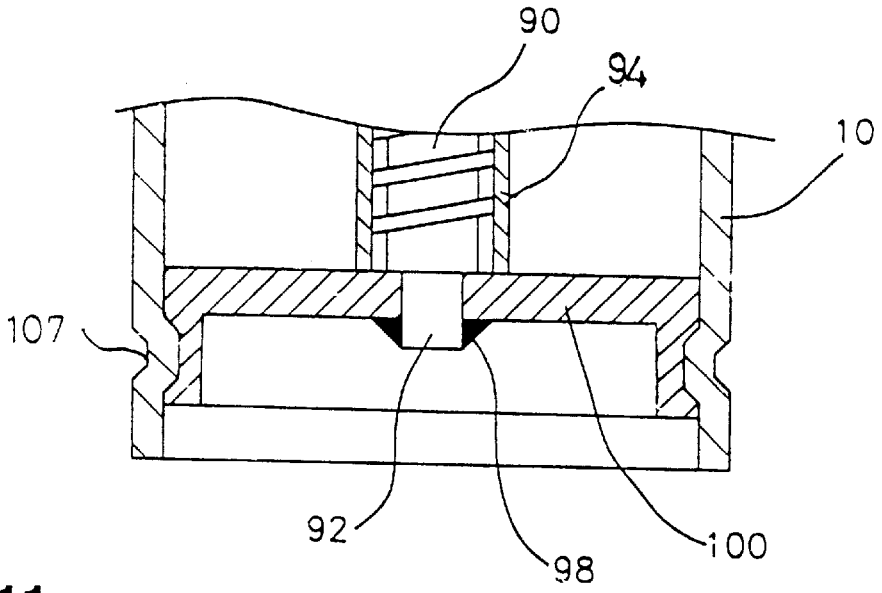
Fig. 10 Prior Art
FIG. 10 is a cross-sectional view showing how a screw shaft is fixed to a fixer in the conventional swivel chair.
Figure 11:
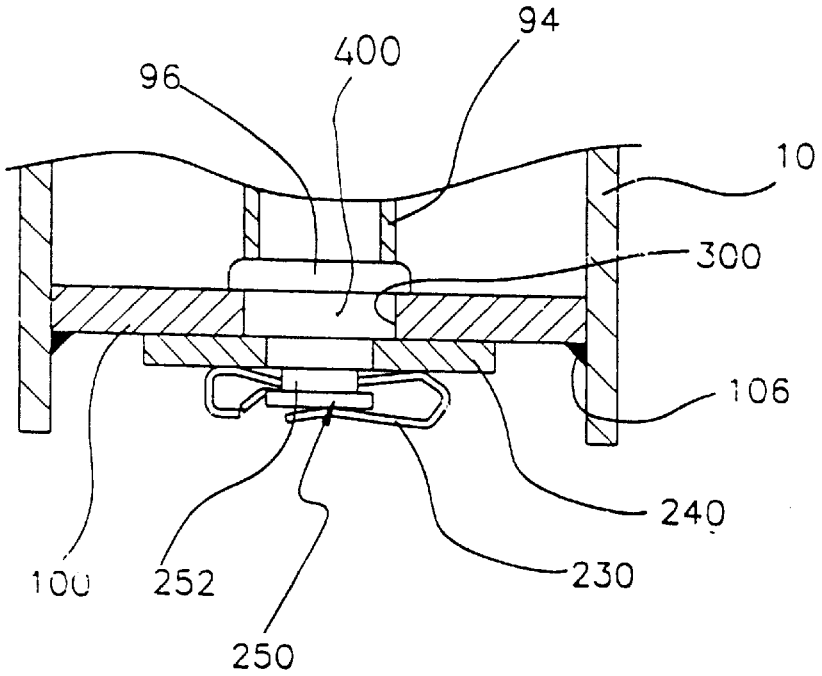
FIG. 11 is a cross-sectional view showing a screw shaft fixed by a clip in the present invention.
Figure 12:
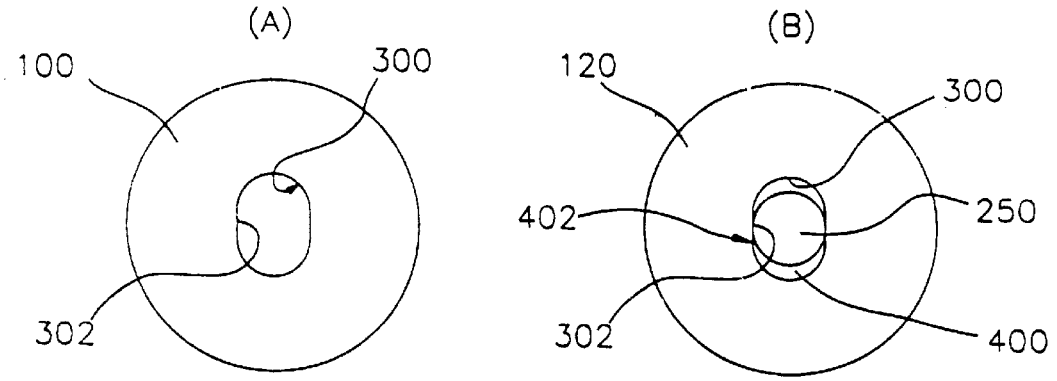
FIGS. 12 to 15 show various types of an idling protection hole of the present invention, wherein group (A) are plane views of the bottom of an outer case, and group (B) are bottom plane views of a screw shaft fixed with a fixer.
Figure 13:
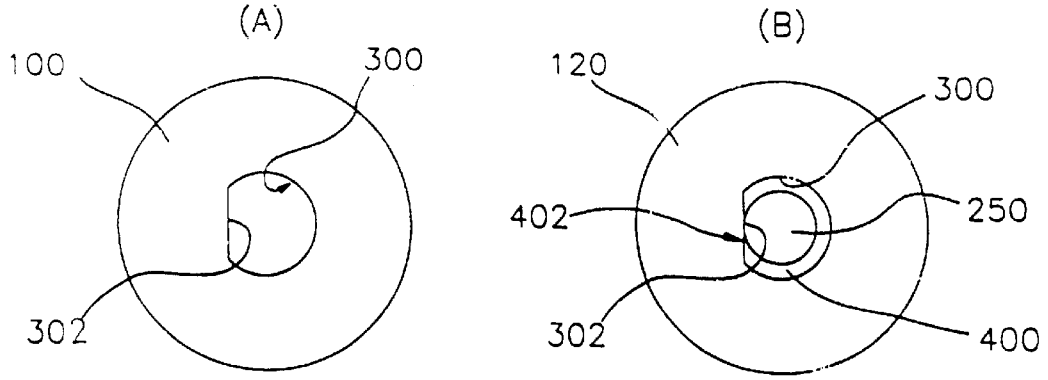
Figure 14:
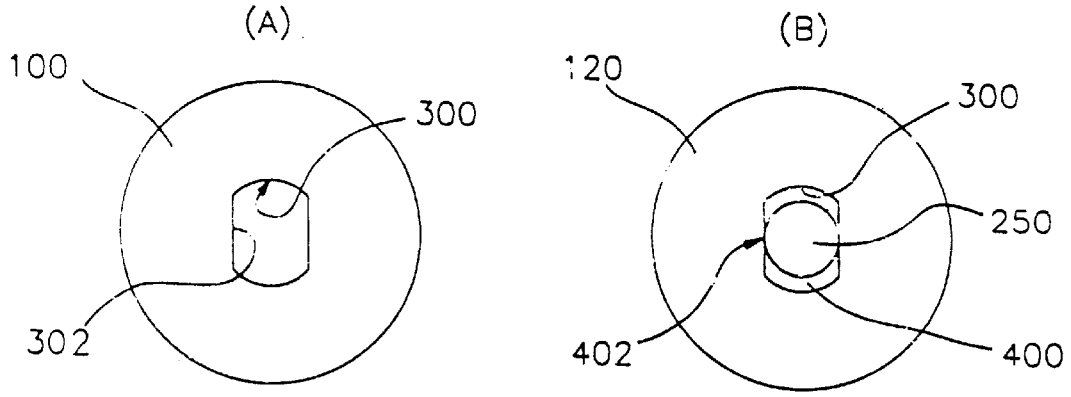
Figure 15:
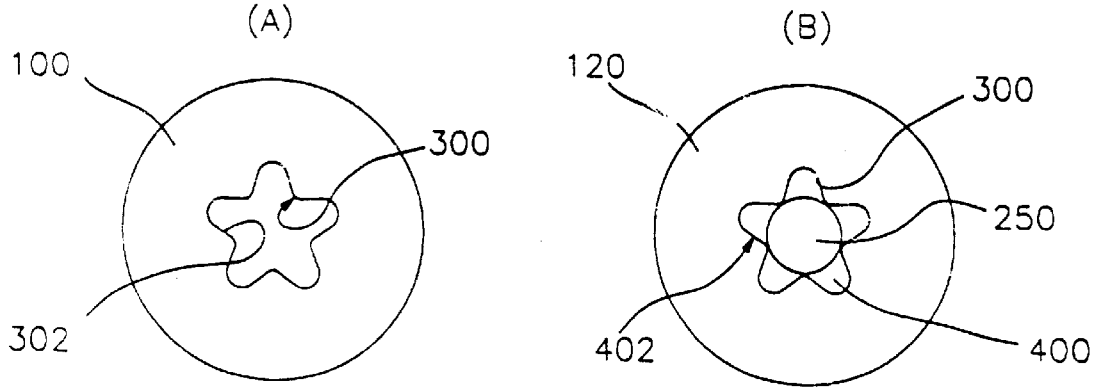

FIG. 9*a* is a cross-sectional view showing a stopper 220 according to one embodiment of the present invention. The stopper 220 of FIG. 9*a* is formed by merging neighboring threads at a preferred position of the screw shaft 90, wherein the diameter of the stopper is not larger than that of the spindle shaft 90. For example, the neighboring threads are pressed together or demolished in order to distort the screw pitch so that the screw nut 70 does not become detached from the screw shaft 90.

The screw nut 70 and the clutch 80 have curved surfaces 79 and 83 of the furrows 78 and ridges 82 so that they are smoothly engaged when the height of the seat is adjusted as shown in FIG. 6. As a result, when the swivel chair of the present invention is being used, there is no noise and the users feel more comfort compared to the conventional chair.

As shown in FIG. 7, the screw spindle assembly of the present invention comprises the spindle bushing 200 which is inserted between the screw shaft 90 and the elastic body 30 so that the elastic body 30 can move up and down without any trembling when the spindle 20 moves down as weight is applied to the seat. Therefore, the elastic body 30 does not rub with other components because it moves up and down in a substantially vertical direction, resulting in no noise.

Furthermore, the protruding portion 206 of the spindle bushing 200 remains in constant contact with the inner surface of the spindle 20 as the spindle moves up and down so that the spindle bushing 200 can guide the movement of the elastic body 30 without any teeter-tottering effect. This accommodates the prevention of noise.

In addition, the protruding portion 206 has a cut away portion 208 on some part of the circumference thereof so that it is inserted into the spindle 20 easily.

As shown in FIGS. 9*a*, the stopper portion 220 has a same diameter as that of the screw shaft. To do that, the stopper 220, for example, is formed by pressing together or demolishing neighboring threads with a press. As a result, the thread of the screw nut 70 or the clutch 80 cannot pass through the stopper 220. On the other hand, the components such as the elastic body 30 and the ball bearing 50 can pass through the stopper 220 and 222 so that it is easy to disassemble the screw spindle assembly.

The screw spindle assembly of the present invention has the following advantages. First, there is no shock and noise because the clutch and the screw nut have curved furrows and ridges. Second, there is no noise resulting from trembling of the elastic body because the spindle bushing guides the elastic body to move up and down precisely in a vertical direction. Third, disassembling of the screw spindle assembly is easy for repairing or replacing the ball bearing component because the stopper has a same diameter as the screw shaft.

What is claimed is:

1. A screw spindle assembly of a swivel chair comprising:

a hollow cylindrical outer case;

a spindle placed in the outer case, the spindle having a tapered hollow cylindrical first end portion fixed to a chair seat and a hollow cylindrical second end portion;

an elastic body placed in the spindle;

a support ring making contact with one end of the elastic body to limit a movement of the elastic body;

a bearing assembly making contact with the other end of the elastic body and placed in the spindle;

a screw nut having internal threads and placed in the spindle, the screw nut having at least one furrow;

a clutch fixed to the second end of the spindle, the clutch having at least one ridge corresponding to the furrow of the screw nut;

a screw shaft placed in the spindle and inserted into the elastic body, the bearing assembly, and the clutch and engaged with the internal threads of the screw nut, wherein the screw shaft has a stopper portion formed at an upper end portion of the screw shaft stopper portion having a same diameter as that of the screw shaft, and the stopper portion being formed by merging neighboring threads in order to distort the screw pitch of the screw shaft so that the screw nut cannot be detached from the screw shaft; and a fixer fixed to one end of the outer case, the screw nut being fixed to a center portion of the fixer;

wherein the furrow of the screw nut and the ridge of the clutch each have a curved surfaces.

2. A screw spindle assembly according to claim 1, wherein a site at which the furrow of the screw nut and the bottom surface portion of the screw nut meet is sloped with an arc-shape.

3. A screw spindle assembly according to claim 1, the screw nut has at least two furrows and the clutch has at least two ridges.

4. A screw spindle assembly of a swivel chair comprising:

a hollow cylindrical outer case;

a spindle placed in the outer case, the spindle having a tapered hollow cylindrical first end portion fixed to a chair seat and a hollow cylindrical second end portion;

an elastic body placed in the spindle;

a support ring making contact with one end of the elastic body to limit a movement of the elastic body;

a bearing assembly making contact with the other end of the elastic body and placed in the spindle;

a screw nut having internal threads and placed in the spindle, the screw nut having at least one furrow;

a clutch fixed to the second end of the spindle, the clutch having at least one ridge corresponding to the furrow of the screw nut;

a screw shaft placed in the spindle and inserted into the elastic body, the bearing assembly, and the clutch and engaged with the internal threads of the screw nut;

a fixer fixed to one end of the outer case, the screw nut being fixed to a center portion of the fixer; and a spindle bushing placed between the screw shaft and the elastic body, the spindle bushing having a cylindrical body which has a cylindrical hole extending along the length-axis of the cylindrical body and a laterally protruding portion protruding from the top of the cylindrical body;

wherein the protruding portion is truncated along a chord extending through the protruding portion in the same plane in which the protruding portion lies.

* * * * *